US010480190B2

(12) United States Patent
Hirmke

(10) Patent No.: US 10,480,190 B2
(45) Date of Patent: Nov. 19, 2019

(54) GLUELAM STRUCTURAL MEMBER AND A METHOD OF PRODUCING SUCH A GLUELAM STRUCTURAL MEMBER

(71) Applicant: Stora Enso OYJ, Helsinki (FI)

(72) Inventor: Markus Hirmke, Rossatz-Arnsdorf (AT)

(73) Assignee: Stora Enso OYJ, Helsinki (FI)

( * ) Notice: Subject to any disclaimer, the term of this patent is extended or adjusted under 35 U.S.C. 154(b) by 241 days.

(21) Appl. No.: 15/501,201

(22) PCT Filed: Aug. 5, 2015

(86) PCT No.: PCT/IB2015/055934
§ 371 (c)(1),
(2) Date: Feb. 2, 2017

(87) PCT Pub. No.: WO2016/020848
PCT Pub. Date: Feb. 11, 2016

(65) Prior Publication Data

US 2017/0226738 A1 Aug. 10, 2017

(30) Foreign Application Priority Data

Aug. 8, 2014 (SE) ..... 1450929

(51) Int. Cl.
*E04C 3/12* (2006.01)
*B27M 3/00* (2006.01)

(52) U.S. Cl.
CPC ..... *E04C 3/122* (2013.01); *B27M 3/0053* (2013.01); *E04C 3/12* (2013.01); *E04C 3/125* (2013.01); *Y10T 428/195* (2015.01)

(58) Field of Classification Search
CPC ..... Y10T 428/195; E04C 3/122; E04C 3/12; E04C 3/14; B27B 1/005; B27M 3/0026; B27M 3/0053; B27M 3/006
See application file for complete search history.

(56) References Cited

U.S. PATENT DOCUMENTS 2,878,844 A 3/1959 Arvid
3,654,741 A * 4/1972 MacDonell ..... B27M 3/0026 52/847

(Continued)

FOREIGN PATENT DOCUMENTS

DE 10200335 8/2002
EP 0167013 A2 1/1986

(Continued)

OTHER PUBLICATIONS

International Search Report for PCT/IB2015/055934, dated Nov. 18, 2015.

(Continued)

*Primary Examiner* — Alexander S Thomas
(74) *Attorney, Agent, or Firm* — Greer, Burns & Crain, Ltd.

(57) ABSTRACT

The present disclosure provides a structural member (10), such as a beam, a stud or a joist, presenting a predetermined bending direction (B). The structural member comprises a plurality of glued-together wood lamellae (20*a*, 20*b*), each having a lamella cross section which is parallel with a cross section of the structural member (10) and a longitudinal direction which is parallel with a longitudinal direction of the structural member and with a principal grain direction of the wood lamellae (20*a*, 20*b*). In the structural member, the lamellae (20*a*, 20*b*) are formed as radial sections of a log and present cross sections which are triangular or trapezoidal and present a respective base surface (bs1) that is formed at a radially outer part of the log. The lamellae (20*a*, 20*b*) are arranged as at least one layer in which base surfaces (bs1) of a pair of immediately adjacent lamellae (20*a*, 20*b*) face opposite directions. The base surfaces (bs1) are perpendicular to the bending direction (B).

9 Claims, 9 Drawing Sheets

(56) References Cited

U.S. PATENT DOCUMENTS

| | | | |
|---|---|---|---|
| 4,111,247 | A | 9/1978 | Hasenwinkle |
| 4,122,878 | A | 10/1978 | Kohn |
| 6,315,860 | B1 | 11/2001 | Holmberg et al. |
| 2005/0000185 | A1 | 1/2005 | Edgar et al. |

FOREIGN PATENT DOCUMENTS

| | | | | |
|---|---|---|---|---|
| GB | 781627 | | * | 8/1957 |
| JP | 2001500076 | A | | 1/2001 |
| JP | 3076430 | U | | 4/2001 |
| JP | 2007015114 | A | | 1/2007 |
| SE | 469880 | B | | 4/1991 |
| WO | 8904747 | A1 | | 6/1989 |

OTHER PUBLICATIONS

Written Opinion of the International Searching Authority for PCT/IB2015/055934, dated Nov. 18, 2015.

* cited by examiner

GLUELAM STRUCTURAL MEMBER AND A METHOD OF PRODUCING SUCH A GLUELAM STRUCTURAL MEMBER

This application is a U.S. National Stage under 35 U.S.C. § 371 of International Application No. PCT/IB2015/055934, filed Aug. 5, 2015, which claims priority to Swedish patent application No. 1450929-3 filed Aug. 8, 2014.

TECHNICAL FIELD

The present disclosure relates to a structural member, which may be used as a beam, a joist, a stud, a pillar or the like. The disclosure also relates to a method of producing the structural member.

BACKGROUND

Currently, glue-laminated beams ("gluelam") in Europe are mostly produced according to DIN 1052:2008 (German standard) or DIN EN 14080: 2013-09 (harmonized European standard). The beams 1 (FIG. 1) are built up with visually graded or machine graded boards 2, which are produced and kiln-dried in sawmills in the traditional way.

The gluelam producer takes these boards as raw material, grades them and produces the required lamellae by cutting out defects (e.g. knots) and finger-jointing 3 the pieces together. After the finger-jointed lamellae 2 have been planed, glue is applied and the beam 1 is formed by gluing the lamellae 2 together. The final steps may comprise planing the beam, removing optical defects, packaging and loading it.

Hence, traditionally, timber is sawn into planks or lamellae according to the scheme depicted in FIG. 1 of U.S. Pat. No. 5,816,015, which discloses alternative methods of forming wood beams by laminating together a plurality of planks or lamellae.

EP1277552A2 discloses a similar method of forming a wood beam by cutting a round piece of timber into a plurality of strips having a trapezoidal cross section and laminating together the pieces thus formed into a beam.

U.S. Pat. No. 4,122,878 discloses a method of converting balsa wood of relatively small diameter into panels.

There is still a need to provide improved use of the timber raw material, as well as a need for beams having improved strength and/or reduced variation in strength between different beams.

SUMMARY

It is a general object of the present invention to provide an improved structural member, such as a beam, a joist, a stud, a pillar or the like. A particular object includes the provision of a structural member which makes better use of existing raw materials and which is stronger. Further objects include the provision of improved control of the production process of structural members, such that properties of resulting members will present less variation.

The invention is defined by the appended independent claims. Embodiments are set forth in the dependent claims, in the following description and in the attached drawings.

According to a first aspect, there is provided a structural member, such as a beam, a stud or a joist, presenting a predetermined main bending direction. The structural member comprises a plurality of glued-together wood lamellae, each having a lamella cross section which is parallel with a cross section of the structural member and a longitudinal direction which is parallel with a longitudinal direction of the structural member and with a principal grain direction of the wood lamellae. The lamellae are formed as radial sections of a log and present cross sections which are triangular or trapezoidal and present a respective base surface that is formed at a radially outer part of the log. The lamellae are arranged as at least one layer in which base surfaces of a pair of immediately adjacent lamellae face opposite directions. The base surfaces are perpendicular to the bending direction.

The term "trapezoid" is the American English equivalent of the British English term "trapezium". The term "trapezoid is defined as a convex quadrilateral with one pair of parallel sides, referred to as "bases" and a pair of non-parallel legs.

The term "bending direction" can be replaced with "transversal load direction", which is perhaps more relevant for the case where the structural member is in the form of a beam which receives a transversal load over all or part thereof.

The invention is thus based on the understanding that strength properties (tensile as well as bending strength) increase radially from pith to bark. Hence, the youngest (i.e. most outside lying) wood is the most valuable in terms of strength properties. While today's sawmilling technology results in most of the outside lying wood being converted into chips and not into sawn-goods, the present invention provides for an enhanced use of the most valuable wood, since the inventive concept will result in the forming of pieces of wood which will always include the outermost part of the log.

It is estimated that beams formed according to the present disclosure can achieve about 10% increase in strength properties given the same amount of raw material used.

The lamellae may have the shape of an isosceles triangle and/or of an isosceles trapezoid.

Although other cross sections are possible, including varying or alternating cross sections, an isosceles trapezoid shape for all lamellae would appear to be the most practical one from a production perspective.

In the lamellae, an annual ring radius of curvature may decrease with an increasing distance from the base surface.

Hence, the youngest portion of the wood will be present at the major base surface and the age of the wood will increase gradually towards the minor base surface or towards the triangle apex, as the case may be.

The structural member comprises at least two glued-together layers of lamellae that are arranged such that base surfaces of a pair of immediately adjacent lamellae face opposite directions.

Hence, the present disclosure provides a modular approach to the design of structural members in that standardized building blocks may be used to form a variety of structural members having different properties.

The layers may present different thickness as seen in a direction perpendicular to the base surfaces.

A layer that is positioned closer, as seen in the bending direction, to an outer face of the structural member presents a smaller number of annual rings than a layer that is positioned further away from the outer face.

In the layer having the smaller number of annual rings, those lamellae whose base surfaces face the same direction and which constitute the greatest part by volume of that layer, may have a greater average annual ring radius of curvature than the lamellae of the layer that is positioned further away from the outer face.

Hence, the outer layer will have higher strength.

The lamellae may be formed of pieces of wood that are radial sectors of a log having their respective apex and arc portions cut away.

The lamellae may present a trapezoidal cross section, and the major base surfaces of the lamellae may present less cut-off wood fibers per area unit than the minor base surfaces of the lamellae.

Hence, the wood fibers at the major base surface will be intact to a higher degree than the wood fibers at the minor base surface. This means that the quality of the wood fibers having the greatest strength will be preserved and maximum use will be made of the inherent strength of the raw material.

At least one of the lamellae may be formed by at least two pieces of wood, which are joined together short side to short side, preferably by means of a finger joint.

According to a second aspect, there is provided a gluelam beam comprising a structural member as described above, wherein the beam has an elongate cross section presenting a horizontally oriented short side, wherein the base surfaces are parallel to the short side.

According to a third aspect, there is provided use of a structural member as described above as a beam, a joist, a stud, a pillar or a wall element.

A beam in this regard may be a straight horizontal beam or a slanted beam, i.e. a beam having an angle of 0°-90° relative to a horizontal direction.

A beam may also be curved.

A wall element may be used to provide all or part of a wall. Typical wall elements may have a height corresponding to a desired room height, typically about 2.1-4 m, perhaps most likely in the range of 2.2-3 m. A width of such a wall element may be e.g. from 0.6 m to 25 m, perhaps most likely 0.6-15 m or 0.6-6 m.

According to a fourth aspect, there is provided a method of forming a structural member, such as a beam, a stud or a joist, presenting a predetermined main bending direction. The method comprises cutting a log along a principal grain direction of the log, into a plurality of wood lamellae which are triangular or trapezoidal in cross section and present a respective base surface that is formed at a radially outer part of the log. The method further comprises arranging the lamellae as at least one layer in which base surfaces of a pair of immediately adjacent lamellae face opposite directions, and gluing together the lamellae along long sides thereof. The method also comprises arranging the lamellae such that the base surfaces are perpendicular to the bending direction.

In the method, the lamellae may be formed with an isosceles triangular or an isosceles trapezoidal cross section.

The forming of the lamellae into trapezoid cross section may comprise aligning a respective major base surface of the lamella to be formed with an outermost surface of the log, such that less wood fibers per area unit are cut off at the major base surface than at a minor base surface.

The method may comprise a drying step, wherein the lamellae are dried, preferably kiln-dried, to a moisture content suitable for lamination.

The method may further comprise a planing step, wherein the lamellae and/or the layers are planed to provide a sufficiently plane surface for lamination.

The method may comprise cutting away a portion of the layer comprising the base surfaces and gluing this portion to an opposing side of the layer or to a part of another layer forming part of the structural member and being parallel with the cut away portion.

According to yet another inventive concept, there is provided a building component, such as a beam, a stud, a joist or a sheet, comprising a plurality of glued-together wood lamellae, each having a lamella cross section which is parallel with a cross section of the structural member and a longitudinal direction which is parallel with a longitudinal direction of the structural member and with a principal grain direction of the wood lamellae. The lamellae are formed as radial sections of a log and present cross sections which are trapezoidal and present a respective base surface that is formed at a radially outer part of the log. The lamellae are arranged as at least one layer in which base surfaces of a pair of immediately adjacent lamellae face opposite directions. Major base surfaces of the lamellae present less cut-off wood fibers per area unit than minor base surfaces of the lamellae.

Hence, the wood fibers at the major base surface will be intact to a higher degree than the wood fibers at the minor base surface. This means that the quality of the wood fibers having the greatest strength will be preserved and maximum use will be made of the inherent strength of the raw material.

This second inventive concept may be used with or without base surfaces that are perpendicular to a bending direction or transversal load direction of the building component.

In the lamellae, an annual ring radius of curvature may decrease with an increasing distance from the base surface.

Hence, the youngest portion of the wood will be present at the major base surface and the age of the wood will increase gradually towards the minor base surface or towards the triangle apex, as the case may be.

The building component may comprise at least two glued-together layers of lamellae that are arranged such that base surfaces of a pair of immediately adjacent lamellae face opposite directions.

Hence, the present disclosure provides a modular approach to the design of building components in that standardized building blocks may be used to form a variety of building components having different properties.

The layers may present different thickness as seen in a direction perpendicular to the base surfaces.

A layer that is positioned closer, as seen in a bending direction or transversal load direction, to an outer face of the building component presents a smaller number of annual rings than a layer that is positioned further away from the outer face.

In the layer having the smaller number of annual rings, those lamellae whose base surfaces face the same direction and which constitute the greatest part by volume of that layer, may have a greater average annual ring radius of curvature than the lamellae of the layer that is positioned further away from the outer face.

Hence, the outer layer will have higher strength.

The lamellae may be formed of pieces of wood that are radial sectors of a log having their respective apex and arc portions cut away. According to a second aspect of the second inventive concept, there is provided use of a building component as described above as a beam, a joist, a stud, a pillar or a wall element.

According to a third aspect of the second inventive concept, there is provided a method of forming a building component, such as a beam, a stud, a joist or a sheet, presenting a predetermined main bending direction. The method comprises cutting a log along a principal grain direction of the log, into a plurality of wood lamellae which are trapezoidal in cross section and present a respective base surface that is formed at a radially outer part of the log. The method further comprises arranging the lamellae as at least one layer in which base surfaces of a pair of immediately adjacent lamellae face opposite directions, and gluing together the lamellae along long sides thereof. The forming of the lamellae into trapezoid cross section comprises aligning a respective major base surface of the lamella to be formed with an outermost surface of the log, such that less wood fibers per area unit are cut off at the major base surface than at a minor base surface.

DETAILED DESCRIPTION

In the present disclosure, the inventive concept will be illustrated with reference to a beam 10, which presents a cross section and a longitudinal direction L, and which will typically be intended to receive and support one or more loads, which may be distributed more or less evenly over all or parts of the longitudinal direction of the beam 10. In most practical situations, the force will be vertical, and so the vertical bending of the beam 10 will be the most relevant.

Figure 1:
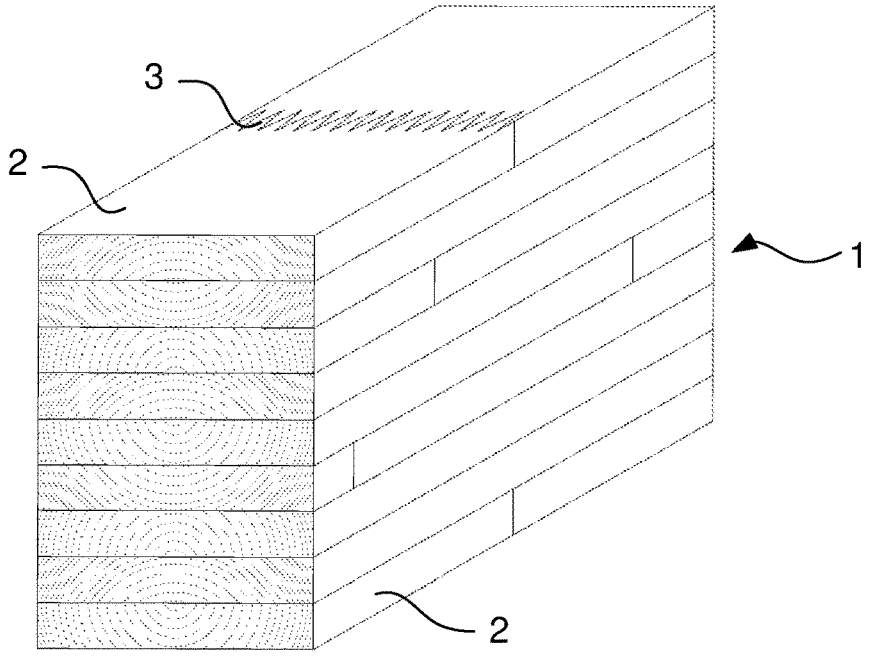
Fig. 1 (Prior art)
FIG. 1 schematically illustrates a prior art gluelam beam.
Figure 2:
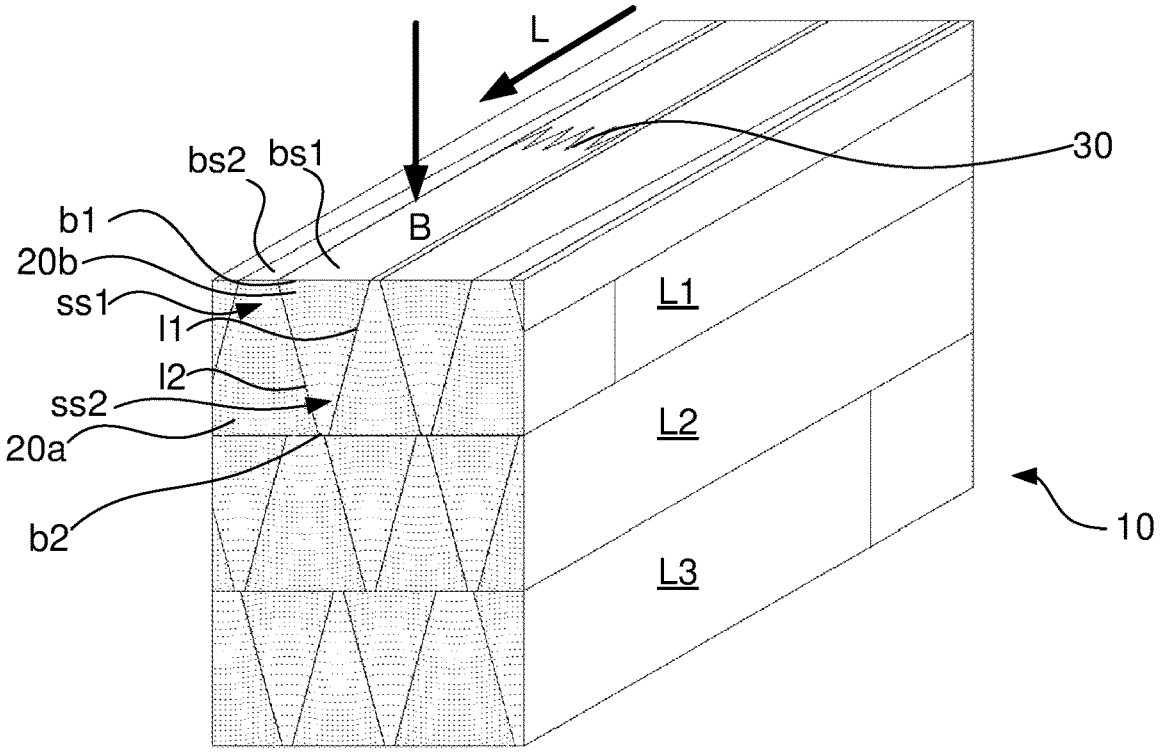
FIG. 2 schematically illustrates a gluelam beam according to the present inventive concept.

The cross section may, as illustrated in FIG. 2, be substantially rectangular with short sides of the rectangle being substantially horizontal. For simplicity, the surfaces defined by the short sides will be referred to as "upper side" and "lower side". The long sides of the rectangle define side surfaces of the beam. Such a beam may be arranged substantially horizontally, or it may extend more or less at an angle to the horizontal direction, for example to support a staircase, a roof, etc. As yet another example, the beam may be curved, for example to support a curved roof.

FIG. 2 thus schematically illustrates a beam 10, which is formed of three layers L1, L2, L3 of lamellae 20*a*, 20*b*. A bending direction B is illustrated as the direction in which a typical transversal load will act upon the beam 10. Hence, for a beam which is subjected to a transversal load (e.g. a perpendicularly oriented load), the bending direction B will coincide with the transversal load direction.

The lamellae 20*a*, 20*b* present a respective cross section, which, in the illustrated example, has the shape substantially of an isosceles trapezoid, which is the result of the lamellae being formed by radially sectioning a log or a piece of timber.

Each lamella cross section will thus present a pair of bases b1, b2 defining respective base surfaces bs1, bs2 of the lamellae 20*a*, 20*b* and a pair of legs 11, 12 defining respective side surfaces ss1, ss2 of the lamella 20*a*, 20*b*. The base surfaces bs1, bs2 comprise a major base surface bs1 and a minor base surface bs2. In each lamella, the major base surface bs1 is formed at an outer portion of the log, closer to the bark than to the pith and the minor base surface bs2 is formed at an inner portion of the log, closer to the pith. It is preferable to provide the longitudinal sides of the major base surface bs1 to coincide with the lateral surface of the useful part of the log (i.e. the outermost part of the log when the bark has been cut away.

The lamellae 20*a*, 20*b* in each layer L1, L2, L3 are arranged side surface ss1 to side surface ss2 with major base surfaces bs1 of immediately adjacent lamellae 20*a*, 20*b* facing opposite directions.

Hence, in e.g. the uppermost layer L1 of FIG. 2, the upwardly facing surface of the beam 10, will be formed by major base surfaces bs1 and minor base surfaces bs2, which are presented alternating as seen in a width direction of the beam 10. The upwardly and/or downwardly facing surface of the beam may thus consist essentially to at least 50%, preferably at least 60%, at least 70%, at least 80%, at least 90%, at least 95% or at least 98%, of the major base surfaces bs1.

Figure 3A:
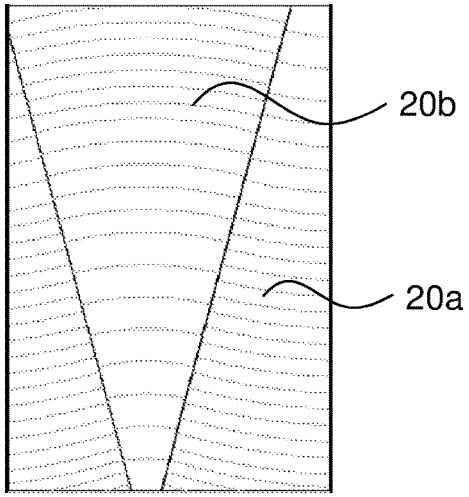
FIGS. 3*a*-3*c* schematically illustrate different embodiments of gluelam beams according to the present inventive concept.

FIG. 3*a* schematically illustrates the simplest form of beam or joist that can be formed according to the present inventive concept, with a single layer of lamellae 20*a*, 20*b* which are laminated side by side with major base surfaces bs1 facing alternating upwardly and downwardly, respectively.

Figure 3B:
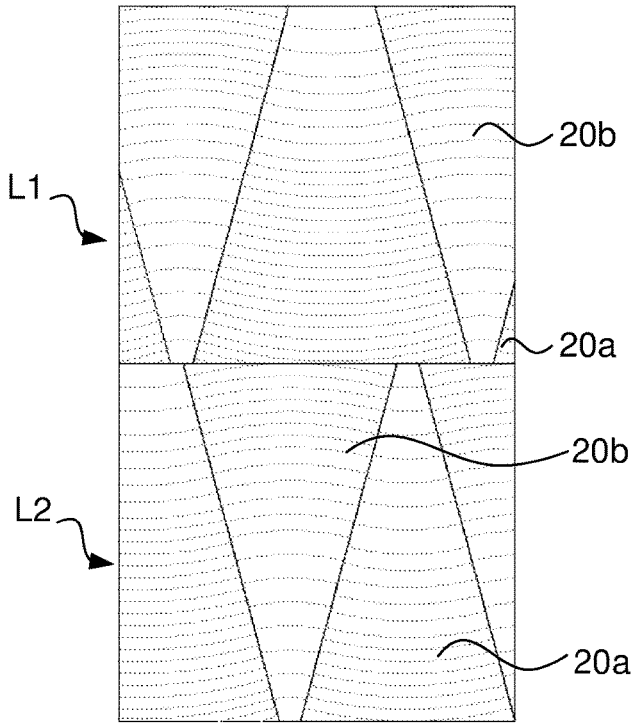

FIG. 3*b* schematically illustrates a two-layer beam or joist that can be formed according to the present inventive concept. This beam is thus formed by two layers L1, L2 of lamellae, each of which are formed according to what has been discussed above with reference to FIGS. 2 and 3*a*. The layers L1, L2 may be laminated together by gluing using conventional gluing technique. In order to provide a longer structural member, it is possible to join together layers L1, L2 of lamellae, e.g. by finger jointing, prior to the joining of the layers. L1, L2 to form the structural member.

Figure 3C:
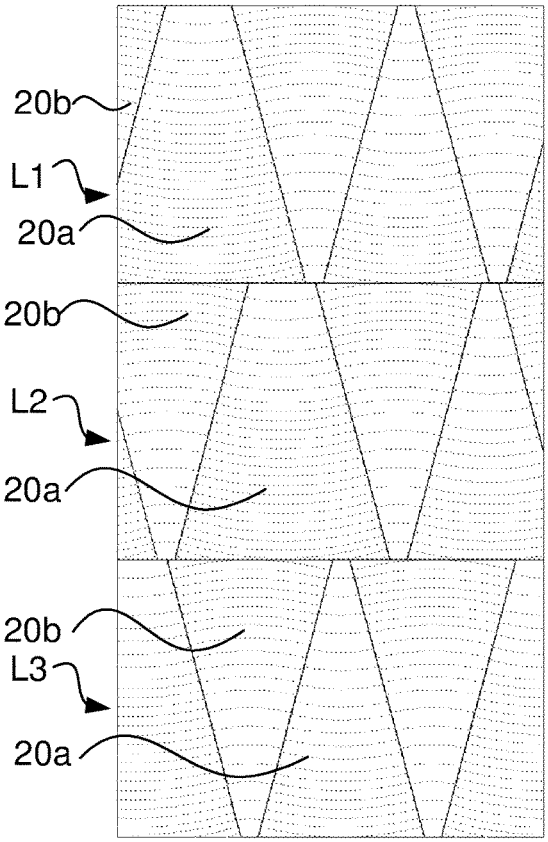

FIG. 3*c* schematically illustrates a three-layer beam or joist that can be formed according to the present inventive concept and similarly to that of FIG. 3*b*. Hence, in this embodiment, the beam is formed of three layers L1, L2, L3 of lamellae 20*a*, 20*b*, each layer being formed as disclosed above with reference to FIGS. 2, 3*a* and 3*b*.

Each layer may typically have a thickness of about 5-20 cm, preferably about 10-15 cm. A beam may be formed of as many layers as deemed necessary. Current standard beams are available at a height of up to 1.2 m, which would translate into a beam having 6-24 layers. Most likely, a beam of that height would have 10-12 layers.

Figure 4:
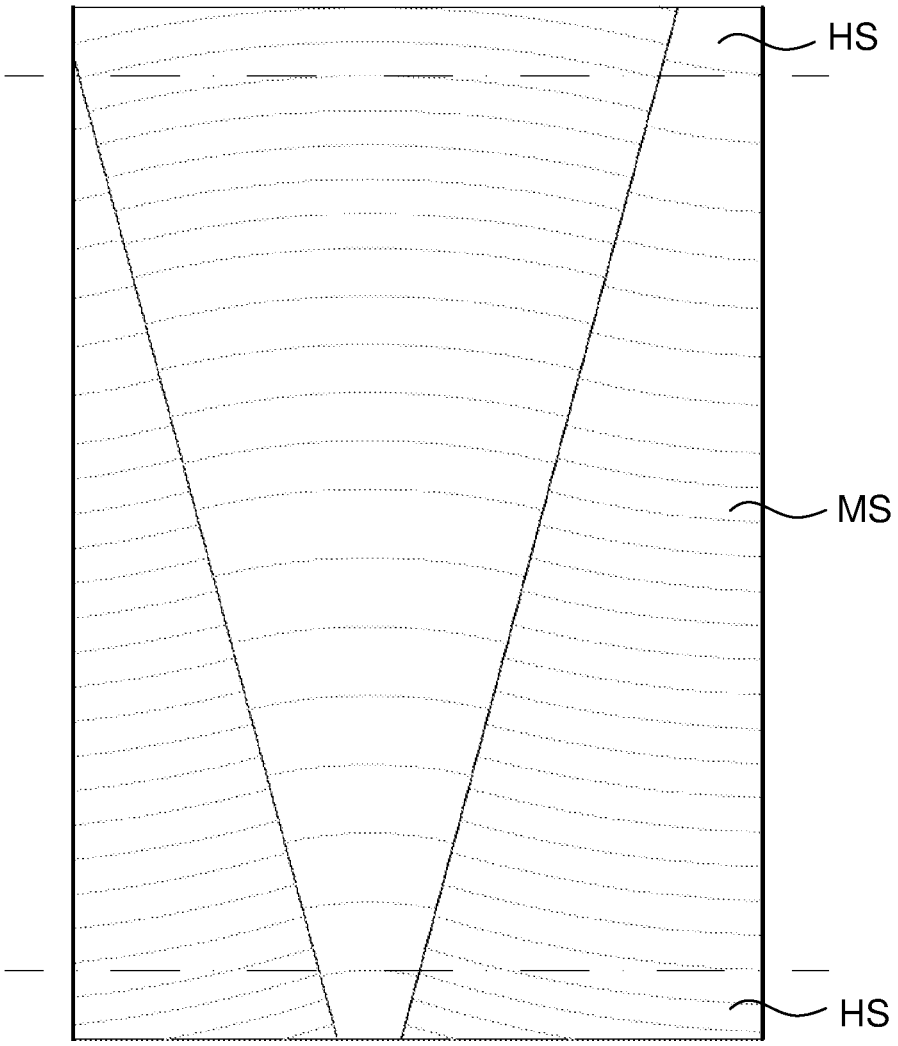
FIG. 4 schematically illustrates a part of a layer of a gluelam beam according to the present inventive concept.

FIG. 4 schematically illustrates an enlarged view of the product illustrated in FIG. 3*a*. As the uppermost and lowermost portions are formed mainly by the outer wood, i.e. the younger wood, high strength zones HS will be provided at the uppermost and lowermost portions, while a middle strength zone MS will be provided in between.

As can be seen in FIG. 4, the high strength zones HS will consist mainly of wood from the outermost part of the log. This would then provide an optimal beam, as it would be the strength of the uppermost and lowermost portions that would be decisive for the bending strength of the beam.

Visually, the zones HS, MS can be distinguished by the radius of curvature of the annual rings: the high strength zone HS will have a larger proportion of annual rings having a greater radius of curvature than the middle strength zone MS.

It is currently not possible to provide a clear limit on what is a high strength zone and what is a middle strength zone. The decision on how to define the zones may be based on experimental strength data and on due regard to the cost of carrying out the "moving" operation.

Figure 5A:
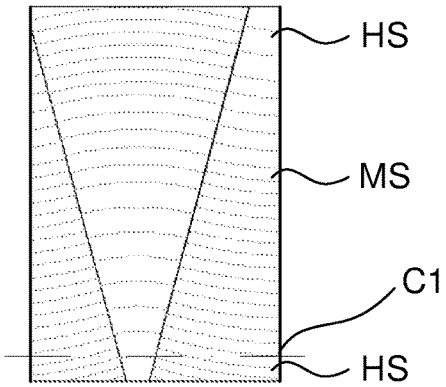
FIG. 5*a*-5*c* schematically illustrate different embodiments of gluelam beams according to the present inventive concept.

In FIG. 5*a*, there is illustrated the case of FIG. 3*a*, which will thus present high strength zones at the upper and lower surfaces and a middle strength zone in between. As is illustrated in FIG. 5*a*, a high strength zone HS may be cut away, e.g. by sawing at the line C1, and moved, as will be discussed below.

Figure 5B:
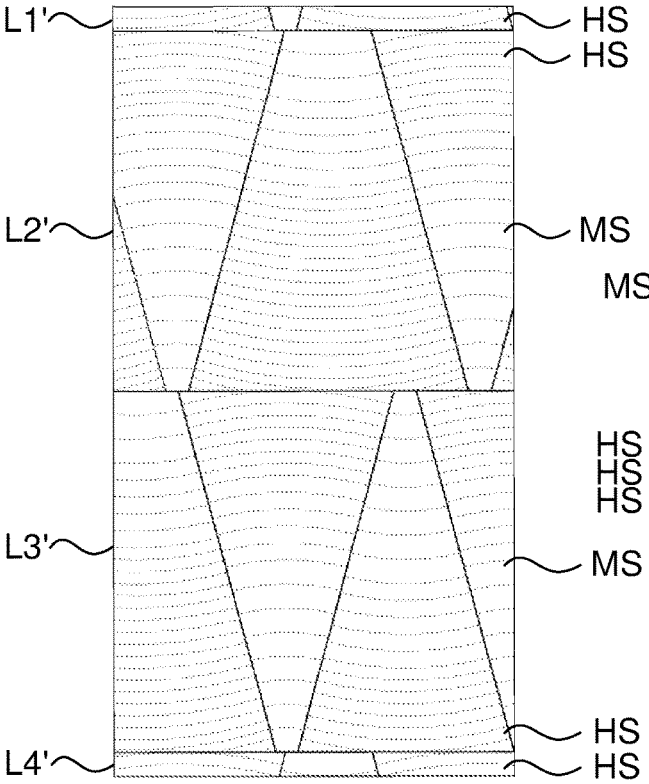

In FIG. 5*b*, there is illustrated an embodiment wherein the beam or joist is formed of four layers L1', L2', L3', L4': a pair of central layers L2', L3' and a pair of outermost layers L1', L4'. It is noted that the most centrally located high strength zones HS of the central layers L2', L3' have been removed and laminated as outermost layers L1', L4'. Hence, effectively, the high strength zones HS have been moved from a central location, where they are of less use, to an outermost location, where better use will be made of their strength.

These moved high strength zones will appear as outer layers that have smaller thickness in the vertical direction than the central layers L2', L3'. For example, an average radius of curvature of the annual rings of the outer layer L1', L4' lamellae may be greater than an average radius of curvature of the central layers L2', L3'.

Figure 5C:
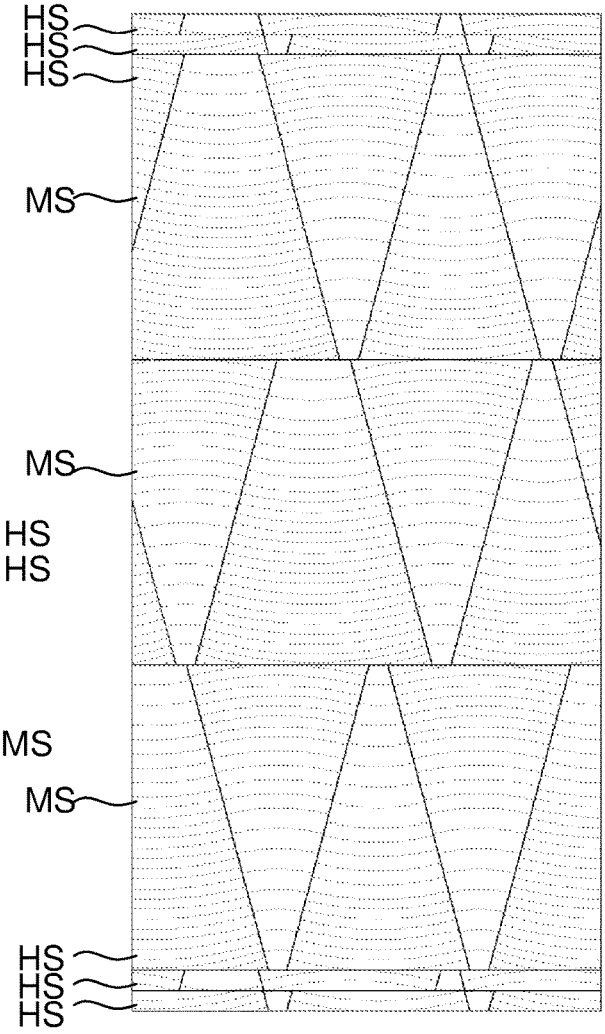

In FIG. 5*c*, there is illustrated a concept similar to that of FIG. 5*b*, but with the beam or joist having three central middle strength zones MS and six outer high strength zones HS, each outer layer being formed by "moving" the centrally located high strength zones HS.

The description will now be directed towards a method for production of the beam described above. As mentioned above, the number of layers to be included in the beam is a matter of selection.

Figure 6A:
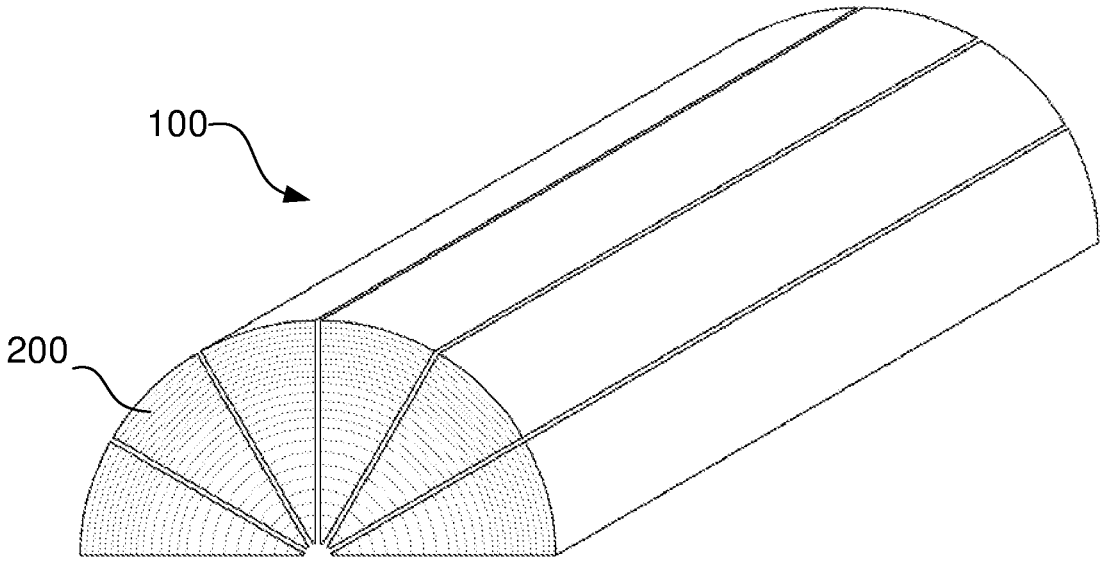
FIGS. 6*a*-6*j* schematically illustrate steps which may be used in the production of a gluelam beam according to the present inventive concept.

In FIG. 6*a*, there is illustrated a log 100 which has been longitudinally cut in half and then radially sectioned into six segments 200, i.e. 12 segments per log. Hence, each segment will have an apex angle of 30°. It is noted that the number of segments into which each log will be sectioned may be selected according to what is deemed appropriate. As a rule of thumb, the greater the log diameter, the greater the number of segments. As another example, 16 segments may be a suitable alternative, with the apex angle then being 22.5°.

As examples, the starting material 100 may be a complete log or a longitudinally cut log (as illustrated in FIG. 6*a*). The log may be regarded as cylindrical (or semi-cylindrical) or as a truncated cone. In any event, the starting material is radially sectioned, whereby a plurality of lamellae blanks 200 are provided, the cross sections of which being in the form of a segment of a circle.

When cutting the log, it is possible, and perhaps most practical, to form the segments as isosceles trapezoids, as discussed above. However, it is also possible to form the segments with other shapes, such as triangles, trapeziums or trapezoids, and to laminate such shapes together with an ensuing planing step that will provide the final shape of a layer L1, L2, L3.

Figure 6B:
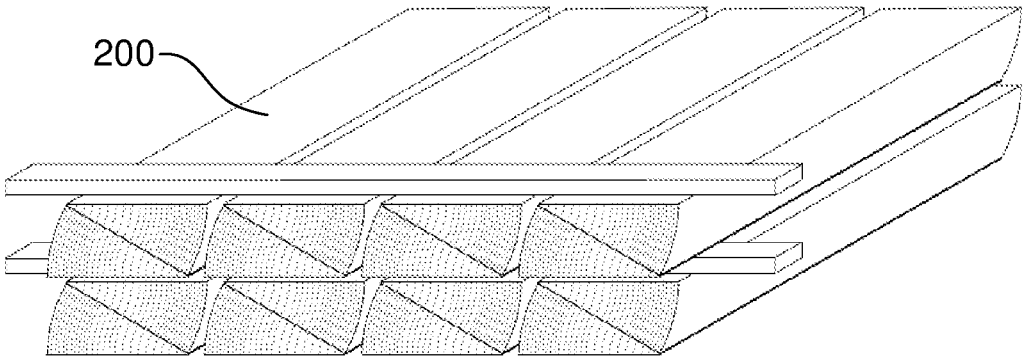

In FIG. 6*b*, there is illustrated a step in which the lamellae blanks 200 prepared in the preceding steps are laid up for drying. The drying process may be any known type of drying process, e.g. a kiln-drying process and the segments 200 may be dried to a moisture content that is suitable for the lamination process that is to be used. There are many different techniques for stacking lamellae, and many different techniques for drying, and no limitation is intended in this regard.

Figure 6C:
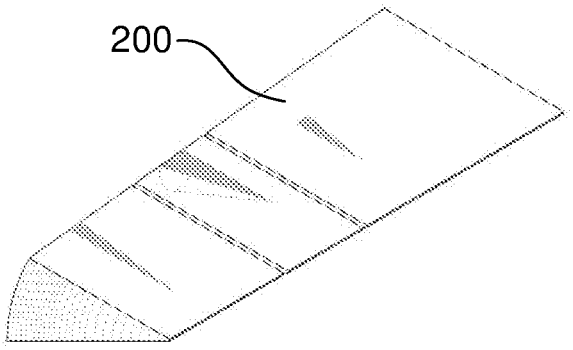

In FIG. 6*c*, there is illustrated a step of identification and removal (cutting away) of defects, such as knots. Processes for identifying and managing defects in wood are known from e.g. U.S. Pat. No. 8,408,081B2 and EP1355148. Parts of the lamellae blanks 200 that are deemed to have insufficient strength may thus be identified and removed, e.g. by cutting away the entire portion of the lamellae blank 200 that is affected by the defect.

Figure 6D:
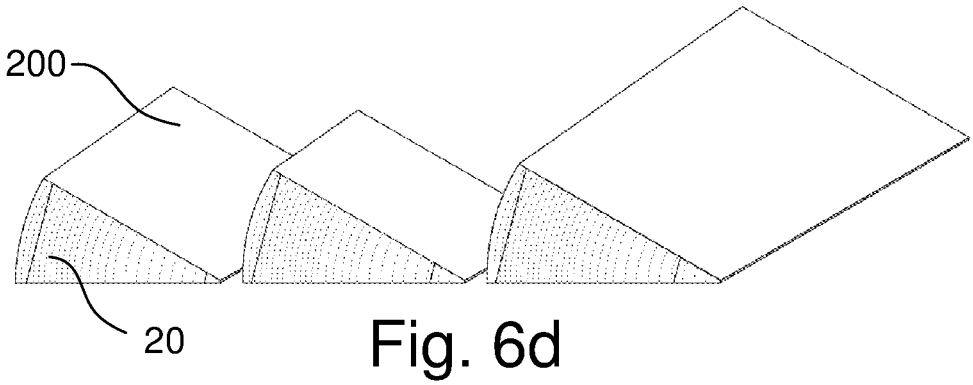

In FIG. 6*d*, there is illustrated a step of optimizing the lamellae. In this step, lamellae blanks 200 are inspected and it is determined what will be the optimal lamellae cross section for each lamellae blank. As is illustrated in FIG. 6*d*, for lamellae blanks having the same original cross section it is possible to provide trapezoidal lamellae having, e.g. differently sized base surfaces and/or different heights. The selection of what cross section to provide may depend on factors such as wood type and quality, occurrence of defects, etc.

Figure 6E:
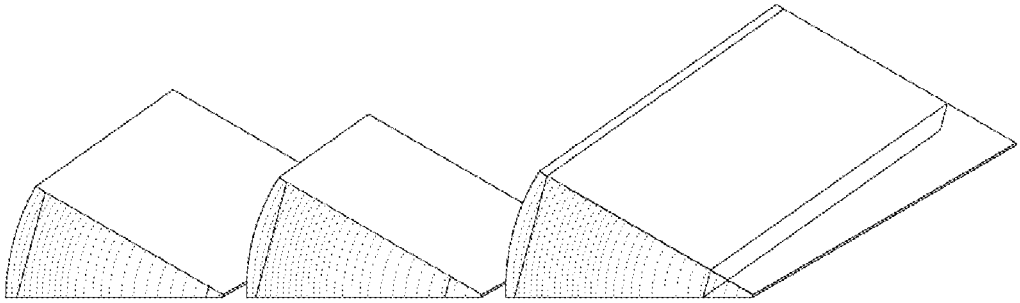

In FIG. 6*e*, there is illustrated a step of formatting lamellae 20 from the lamellae blanks 200. In this step, the segment apex (i.e. the pith) and the segment arc (i.e. the bark or the portion closest to the bark) may be cut away to provide the desired triangular, trapezoidal or isosceles triangular or trapezoidal shape. The formatting may also include planing and/or profiling of the side edges and/or of the base surfaces. The formatting step is typically carried out to achieve the shape determined in the optimization step.

It is noted that while in traditional sawmill practice; a log is treated as a cylinder, wherein the smallest cross section of the log (typically the uppermost part of the log) will define the diameter of the cylinder.

However, a log is actually a truncated cone with a taper of generally about 5-7 mm/m tree height for Norway spruce in middle Europe. Other tapers may apply to different wood species and/or in different locations. Consequently, when using the traditional approach to formatting a lamella, some of the most desirable wood, close to the bark, will be cut away while the less desirable wood, closer to the pith, will be kept.

While the present inventive concept may very well be practiced using this traditional approach, another approach will be described.

In the formatting step, the major base surface bs1 of the trapezoid will be fitted as closely as possible along the outermost surface of the lamella blank, as is illustrated in the far right part of FIG. 6*e*. Consequently, less material will be cut away from the outermost portion of the log and more material will be cut away from the portion closest to the pith.

In consequence, more of the desirable wood will be kept.

As wood fibers actually run parallel to the bark (i.e. the envelope of a truncated cone) rather than along the length direction, of a log (which would assume the log is a cylinder), the traditional method will lead to a lot of wood fibers being cut off at the major base surface bs1. Thus, for each area unit of the base surface, there will appear more cut off wood fibers at the major base surface than at the minor base surface bs2.

However, with the herein described method, there will be less cut off wood fibers per area unit at the major base surface than at the minor base surface, thus resulting in more of the valuable wood being retained where it is needed. Phrased differently, the cutting of the most valuable part of the wood will be more parallel to the fiber direction than in the traditional method.

During the formatting step, the triangle or trapezoid may be taken at a radial distance from the pith which optimizes the use of the lamellae blank 200, bearing in mind that the lamellae blank, as a consequence of being formed from a starting material which is actually slightly frusto-conical in shape, may have a cross section which varies over its length. At the end of the formatting, a lamella in the form of a piece of wood having a prismatic shape with a trapezoidal cross section and a longitudinal direction parallel with the fibers at the outermost part of the log from which it was formed has been obtained.

Figure 6F:
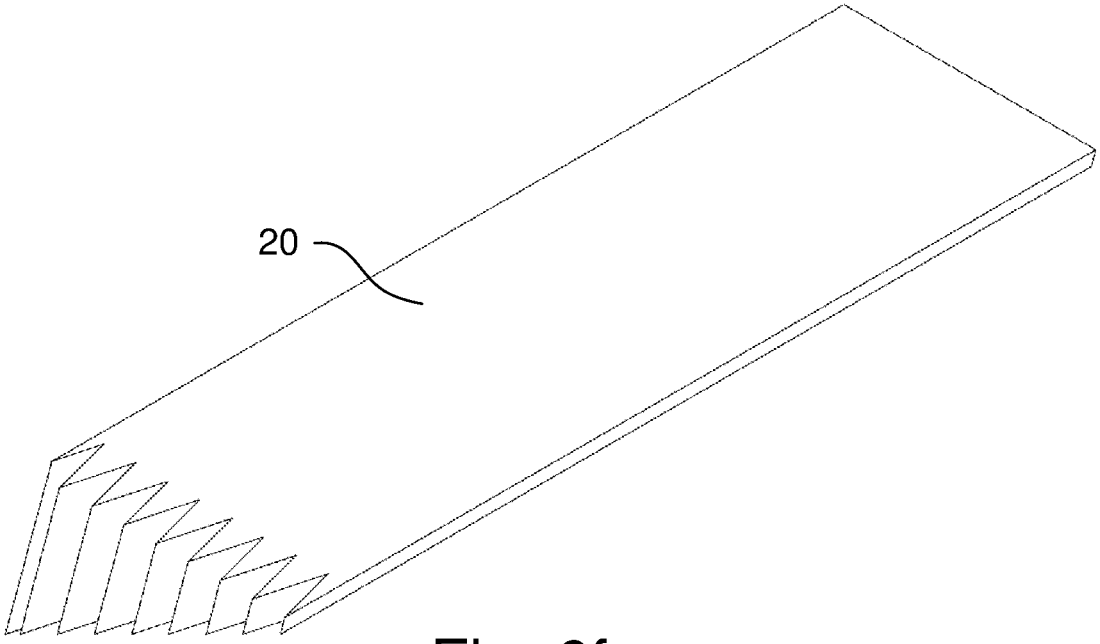

In FIG. 6*f*, there is illustrated a step of providing an end portion of a segment with a finger joint. Joining of wood lamellae is known per se and the fingers may extend parallel with the base surfaces of the isosceles trapezoid, parallel with a side surface of the trapezoid or parallel with a central radius of the lamella blank 200 from which the lamella is formed.

Figure 6G:
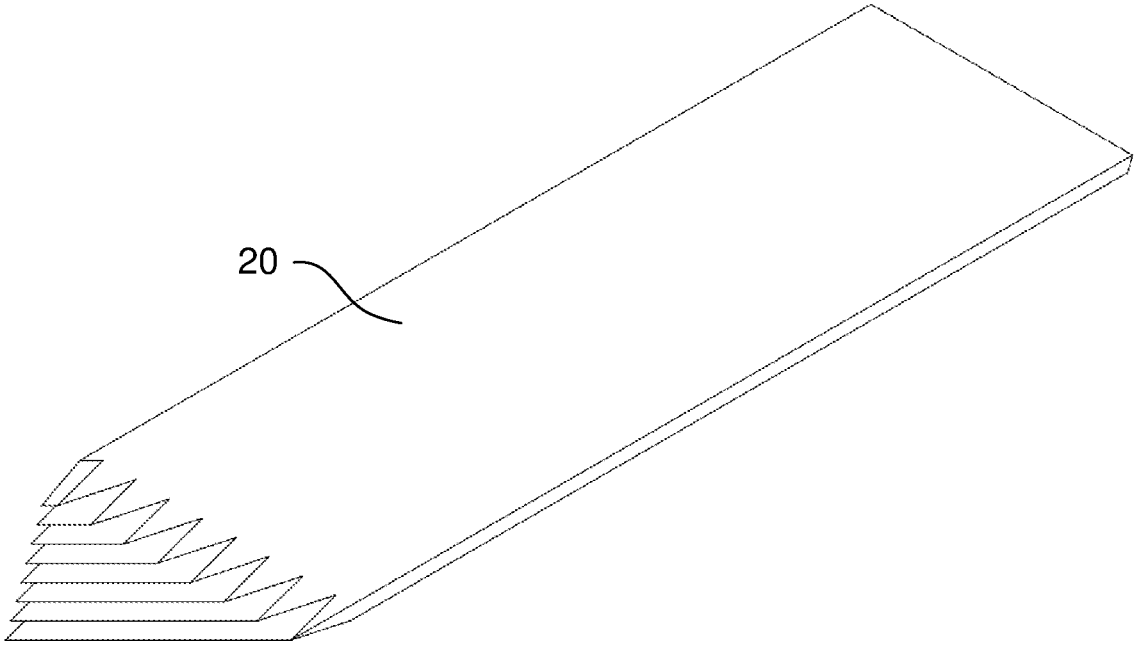

In FIG. 6*g*, there is illustrated an alternative way of providing the finger joint. In this step, the fingers will extend along a side surface of the trapezoid, which may be advantageous for lamellae having a relatively high and narrow cross section as the lamella would rest more stably on the support when the fingers are being cut.

Other types of joints may be used, with a preference for a joint that only involves the use of wood and glue.

Figure 6H:
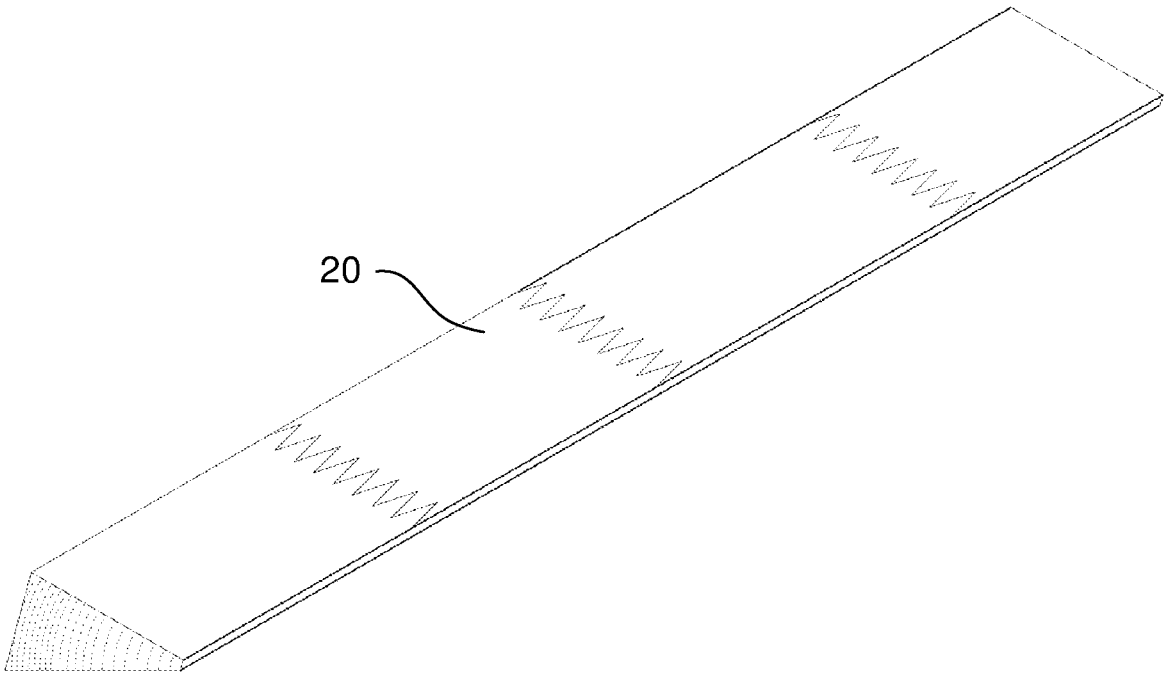

In FIG. 6*h*, there is illustrated a finished lamella, which is formed of a plurality of joined together segments. If the side edges have not previously been planed or formatted, or additional planing or formatting is called for, a side edge planing step may be provided at this point.

Figure 6I:
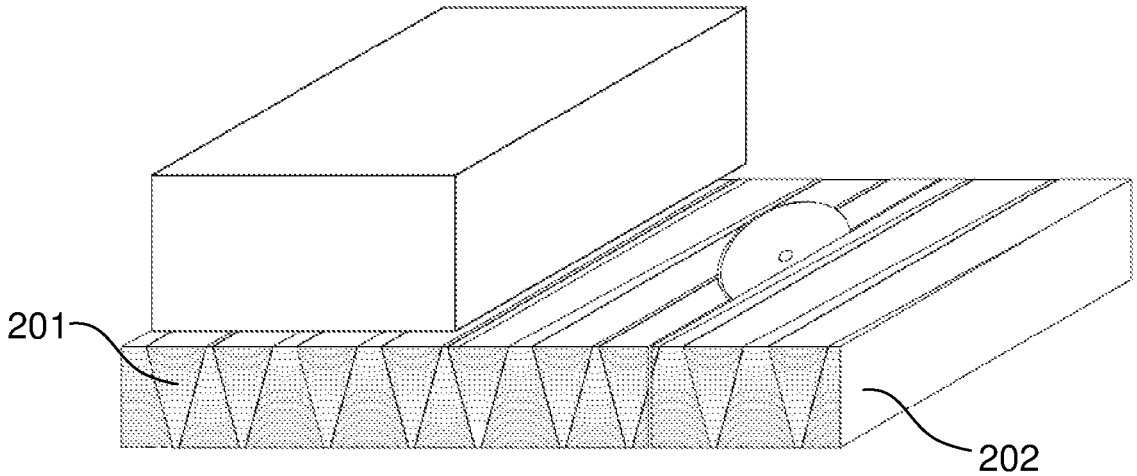

In a non-illustrated step, the finished lamella are arranged with base surfaces bs1, bs2 of immediately adjacent lamellae 20*a*, 20*b* facing opposite directions, whereupon the lamellae 20*a*, 20*b* are glued together side surface ss1 to side surface ss2 to form a sheet 201 having a pair of opposing major surfaces which are formed by the base surfaces bs1, bs2 of the lamellae 20*a*, 20*b*. In this step, the sheet illustrated in FIG. 6*i* is provided. That sheet 201 may be used as is, or further converted, as will be described below.

In FIG. 6*i*, there is illustrated a step of sawing the sheet 201 formed in the preceding step into a plurality of planks 202 having the approximate width of the beam 10 that is to be formed.

In one embodiment (e.g. FIG. 3*a*, 5*a*), the beam or joist may be ready at this point, with optional steps of planing and/or grinding remaining.

In a non-illustrated step, the planks 202 thus produced may be stacked major surface to major surface and glued together to form a beam blank 203.

In one embodiment of the invention (e.g. FIG. 3*b*, 3*c*), each beam 10 may be formed by a predetermined number of planks. Hence, at this point, the beam may be ready, with optional steps of planing or grinding remaining.

Figure 6J:
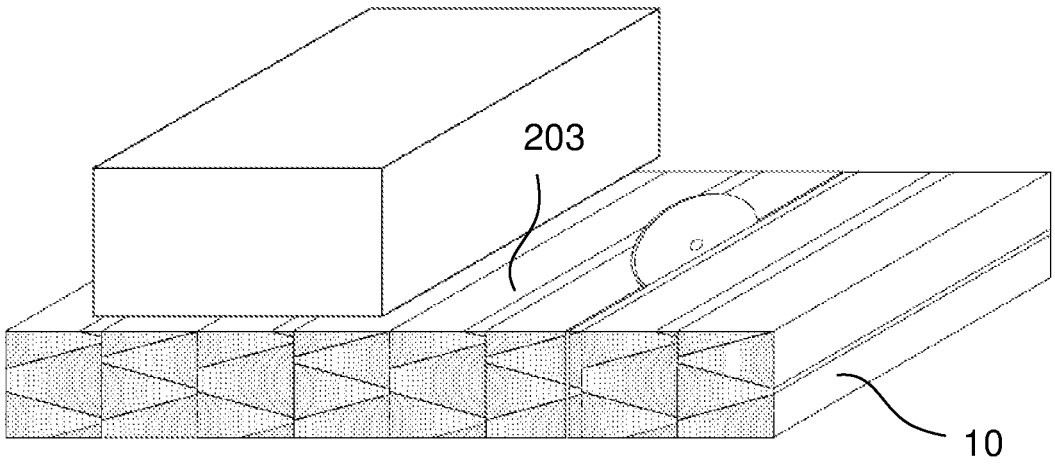

In FIG. 6*j*, there is illustrated a step of sawing the beam blank 203 into beams 10 of suitable height.

While the present disclosure has been given with reference to a beam, which is intended to receive a vertical load, which is distributed over all or part of a length of the beam, it is understood that the subject matter of the present disclosure may also be applied to e.g. floor joists, wall studs, pillars and the like.

Typically, a layer having base surfaces which are parallel to an outermost surface of the structural member can be applied to each longitudinal side of, e.g., a pillar, joist, stud or the like, having a polygonal cross section (such as rectangular, square, pentagonal, hexagonal, etc.) or any other cross section, such as circular or otherwise curved.

For example, in the case of a pillar, multiple bending directions may be defined (typically four for a square or rectangular cross section pillar), whereby a layer L1, L2, L3 may be provided on each side surface of the pillar.

It should also be noted that the sheets illustrated in FIGS. 6*i* and 6*j* may be used as they are shown in the respective figure, for example where a building component, such as a structural board or a wall element, is desired. Board materials may be produced measuring e.g. about 3×15 m with a thickness of 10-20 cm, preferably 10-14 cm. Such boards may be used for constructing walls or wall segments, floors or floor segments and/or ceilings/roofs or ceiling/roof segments.

The invention claimed is:

1. A structural member in the form of a gluelam beam having an elongate cross section presenting a horizontally oriented short side and a predetermined main bending direction, which is perpendicular to the short side, comprising:

a plurality of glued-together wood lamellae, each having a lamella cross section which is parallel with a cross section of the structural member and a longitudinal direction which is parallel with a longitudinal direction of the structural member and with a principal grain direction of the wood lamellae, wherein the lamellae are formed as radial sections of a log, wherein the lamellae present cross sections which are triangular or trapezoidal and present a respective planar major base surface that is formed at a radially outer part of the log, wherein the planar major base surfaces are perpendicular to the main bending direction, and wherein the planar major base surfaces are parallel to the short side of the cross section, wherein the structural member comprises at least two glued-together layers of lamellae that are arranged such that the planar major base surfaces of a pair of immediately adjacent lamellae face opposite directions, and, wherein a layer that is positioned closer, as seen in the main bending direction, to an outer face of the structural member presents a smaller number of annual rings than a layer that is positioned further away from the outer face.

2. The structural member as claimed in claim 1, wherein the lamellae have the shape of an isosceles triangle and/or of an isosceles trapezoid.

3. The structural member as claimed in claim 1, wherein, in the lamellae, an annual ring radius of curvature decreases with an increasing distance from the planar major base surface.

4. The structural member as claimed in claim 1, wherein the layers present different thickness as seen in a direction perpendicular to the planar major base surfaces.

5. The structural member as claimed in claim 1, wherein the lamellae are formed of pieces of wood that are radial sectors of a log having their respective apex and arc portions cut away.

6. The structural member as claimed in claim 1, wherein the lamellae present a trapezoidal cross section, and wherein the planar major base surfaces of the lamellae present less cut-off wood fibers per area unit than minor base surfaces of the lamellae.

7. A gluelam beam in the form of a structural member as claimed in claim 1, wherein the beam has an elongate cross section presenting a horizontally oriented short side, wherein the planar major base surfaces are parallel to the short side.

8. The structural member as claimed in claim 1, wherein an apex angle of the radial sections of the log is 30 degrees or 22.5 degrees.

9. The structural member as claimed in claim 1, wherein, in the layer having the smaller number of annual rings, those lamellae whose planar major base surfaces face the same direction and which constitute the greatest part by volume of that layer, have a greater average annual ring bending radius than the lamellae of the layer that is positioned further away from the outer face.

* * * * *